US007329998B2

(12) United States Patent
Jungwirth

(10) Patent No.: US 7,329,998 B2
(45) Date of Patent: Feb. 12, 2008

(54) LIGHTING SYSTEM INCLUDING PHOTONIC EMISSION AND DETECTION USING LIGHT-EMITTING ELEMENTS

(75) Inventor: Paul Jungwirth, Burnaby (CA)

(73) Assignee: Tir Systems Ltd. (CA)

( * ) Notice: Subject to any disclaimer, the term of this patent is extended or adjusted under 35 U.S.C. 154(b) by 352 days.

(21) Appl. No.: 11/197,283

(22) Filed: Aug. 4, 2005

(65) Prior Publication Data

US 2006/0028156 A1 Feb. 9, 2006

Related U.S. Application Data

(60) Provisional application No. 60/599,048, filed on Aug. 6, 2004.

(51) Int. Cl.
*G05F 1/00* (2006.01)

(52) U.S. Cl. ..... 315/291; 315/149; 315/150

(58) Field of Classification Search ..... 315/291, 315/169.3, 149, 150
See application file for complete search history.

(56) References Cited

U.S. PATENT DOCUMENTS

| | | | | |
|---|---|---|---|---|
| 4,389,118 | A | 6/1983 | Yuasa et al. | |
| 4,797,609 | A | 1/1989 | Yang | |
| 5,268,635 | A | 12/1993 | Bortolini et al. | |
| 5,424,855 | A | 6/1995 | Nakamura et al. | |
| 5,856,727 | A | 1/1999 | Schroeder et al. | |
| 6,111,367 | A * | 8/2000 | Asano et al. | 315/291 |
| 6,236,331 | B1 | 5/2001 | Dussureault | |
| 6,479,942 | B2 * | 11/2002 | Kimura | 315/169.3 |
| 6,495,964 | B1 | 12/2002 | Muthu et al. | |
| 6,617,560 | B2 | 9/2003 | Forke | |
| 2003/0117087 | A1 | 6/2003 | Barth et al. | |

FOREIGN PATENT DOCUMENTS

| | | |
|---|---|---|
| WO | WO 03/017729 | 2/2003 |
| WO | WO 2004/076916 | 9/2004 |

OTHER PUBLICATIONS

Mims III, Forrest, "Sun Photometer with Light-Emitting Diodes as Spectrally Selective Detectors", Applied Optics 31, 6965-6967, 1992.

* cited by examiner

*Primary Examiner*—David H. Vu
(74) *Attorney, Agent, or Firm*—Dorsey & Whitney LLP

(57) ABSTRACT

The present invention provides a system and method for generating light using light-emitting elements and detecting the intensity and spectral power distribution of light using the same light-emitting elements as spectrally sensitive photodetectors. The light-emitting elements function in two modes, an ON mode and an OFF mode, wherein in the ON mode the light-emitting elements are activated and emit light of a particular frequency or range of frequencies. When in the OFF mode, the light-emitting elements are deactivated, wherein they do not emit light but serve to detect photons incident upon them thus generating an electrical signal representative of the intensity and spectral power distribution of the incident photons. The detected signal from the deactivated light-emitting elements can be used to provide photonic feedback to a lighting system, and thereby may be used to control the brightness and color balance of the lighting system. In addition, the light-emitting elements may be arranged such that no spectrally selective filters or optics are necessary to block or focus light onto the light-emitting elements when in the detection or OFF mode.

26 Claims, 8 Drawing Sheets

LIGHTING SYSTEM INCLUDING PHOTONIC EMISSION AND DETECTION USING LIGHT-EMITTING ELEMENTS

CROSS-REFERENCE TO RELATED APPLICATIONS

This application claims the benefit of U.S. Provisional Patent Application No. 60/599,048, filed Aug. 6, 2004, which is hereby incorporated herein by reference.

FIELD OF THE INVENTION

The present invention pertains to the field of lighting systems and in particular to a lighting system including light-emitting elements for use as photonic emitters and detectors.

BACKGROUND

Recent advances in the development of semiconductor and organic light-emitting diodes (LEDs and OLEDs) have made these devices suitable for use in general illumination applications, including architectural, entertainment, and roadway lighting, for example. As such, these devices are becoming increasingly competitive with light sources for example, incandescent, fluorescent, and high-intensity discharge lamps.

Optical feedback for a lighting system can be accomplished using a dedicated optical sensor, for example, a photodiode, phototransistor, or other similar device. U.S. Pat. No. 6,495,964 discloses a technique for using such a dedicated photosensor in an LED lighting system to allow for optical feedback and control of the mixed light by sequentially turning one colour of LED off and measuring the remaining light. There are commercial sensors with up to three separate colour channels to enable simultaneous measurements of both light intensity and relative spectral power distribution of incident light. The presence of these external sensors however, requires spectrally selective filters and optics to block or focus light onto the sensor. This type of configuration can lead to a complex, expensive and large hardware assembly for a lighting system.

It is known to those familiar with the art that light-emitting diodes may be used as photodiodes in either an unbiased photovoltaic mode or a reverse-biased photoconductive mode. Further, the responsivity of said photodiodes is determined by their junction areas. Consequently, LED's commonly referred to as "high brightness" light-emitting diodes (HBLEDs) with large junction areas typically feature high responsivities to incident radiant flux. It is also known that the intensity of HBLEDs can be controlled using Pulse Width Modulation (PWM), Pulse Code Modulation (PCM), or similar techniques wherein the drive current to the diodes can be periodically interrupted or pulsed.

Mims III, Forrest, "Sun Photometer with Light-Emitting Diodes as Spectrally Selective Detectors," Applied Optics 31, 6965-6967, 1992, discloses a technique for using an LED as a spectrally selective detector in a sun photometer for atmospheric measurements. Mims suggests the use of different colours of LEDs exclusively as sensors to measure the light from the sun over a spectral range of 555 nm to 940 nm in the near infrared range, wherein each different colour of LED responds maximally to a different portion of the spectrum. This method of detection however, does not cover the visible spectrum well, which is approximately 400 nm to 700 nm and typically can only measure externally produced light. In addition, Mims describes the spectral responsivity of the LEDs used as being approximately as narrow a band as the emission spectra of the LEDs and therefore each device may detect essentially only a single colour of light.

U.S. Pat. No. 4,797,609 discloses a technique for using unenergized LEDs to monitor the light intensity of adjacent energized LEDs in an array of identical LEDs by directly measuring the current generated in the unenergized LEDs. In practice, the current generated by an LED exposed to light is on the order of microamps, which can be difficult to measure. Without high precision measuring devices and good filtering techniques, these forms of measurements can have a limited useful range.

U.S. Pat. No. 6,617,560 provides a lighting control circuit having an LED that outputs a first signal in response to being exposed to radiation together with a detection circuit coupled to the LED. The detection circuit generates a second signal from the first signal, which is subsequently delivered to a driver circuit that generates a third signal in response thereto. This third signal provides a means for controlling the illumination level of one or more LEDs to which the lighting control circuit is coupled. The configuration of this lighting control circuit defines the use and operation of these LEDs in a photocurrent mode, which enables them to operate solely as light detectors.

Therefore, there is a need for a new system and method for providing photonic emission and detection using light-emitting elements.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a lighting system including photonic emission and detection using light-emitting elements. In accordance with an aspect of the present invention, there is provided a lighting system comprising: one or more light-emitting elements for emission and detection of light; a control means for switching the one or more light emitting elements between a first emission mode and a second detection mode, the control means adapted for connection to a power source; and a signal processing means operatively coupled to the one or more light-emitting elements, the signal processing means for receiving one or more first signals generated by the one or more light-emitting elements in response to light incident thereupon when in the second detection mode.

DETAILED DESCRIPTION OF THE INVENTION

Definitions

Figure 1:
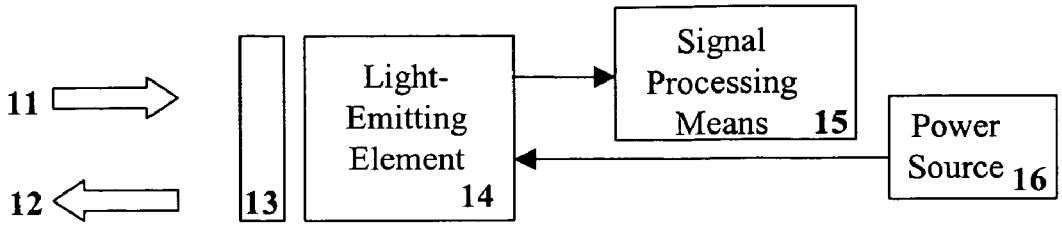
FIG. 1 illustrates one embodiment of the present invention in which a single light-emitting element is used to emit and detect light.

The term "light-emitting element" is used to define any device that emits radiation in any region or combination of regions of the electromagnetic spectrum for example, the visible region, infrared and/or ultraviolet region, when activated by applying a potential difference across it or passing a current through it, for example. Examples of light-emitting elements include semiconductor, organic, polymer or high brightness light-emitting diodes (LEDs) or other similar devices as would be readily understood by a worker skilled in the art.

The terms "light", "colour" and "colour of light" are used interchangeably to define electromagnetic radiation of a particular frequency or range of frequencies in any region of the electromagnetic spectrum for example, the visible, infrared and ultraviolet regions, or any combination of regions of the electromagnetic spectrum.

The term "power source" is used to define a means for providing power to an electronic device and may include various types of power supplies and/or driving circuitry. According to the present invention, the power source may optionally include control circuitry to switch the power ON and OFF for control of the light-emitting elements.

The term "signal processing means" is used to define a device or system that can perform any one or more of conversion, amplification, interpretation, or other processing of signals as would be readily understood. Examples of signal processing include the conversion of an analog signal to a digital signal, the filtering of noise from a signal, signal conditioning using conditioning circuitry for example, amplifiers, and any other means of changing the attributes of a particular signal as would be readily understood.

Unless defined otherwise, all technical and scientific terms used herein have the same meaning as commonly understood by one of ordinary skill in the art to which this invention belongs.

The present invention provides a system and method for generating light using light-emitting elements and detecting the intensity and spectral power distribution of light using the same light-emitting elements as spectrally sensitive photodetectors. The light-emitting elements function in two modes, an ON mode and an OFF mode. When in the ON mode the light-emitting elements are activated, wherein they emit light of a particular frequency or range of frequencies. Light-emitting elements for example, light-emitting diodes (LEDs) may be activated by applying a forward bias across the device. When in the OFF mode, the light-emitting elements are deactivated, wherein they do not emit light but serve to detect photons incident upon them thus generating an electrical signal representative of the intensity and spectral power distribution of the incident photons. Light-emitting elements for example LEDs, may be deactivated by applying a reverse bias or no bias to allow the detection of light in this mode. The detected signal may be used to provide information about other light-emitting elements for example, the decay in light emission of light-emitting elements or to provide photonic feedback to a lighting system, which may then be used to control the brightness and colour balance of the lighting system. In addition, the light-emitting elements may be arranged such that no spectrally selective filters or optics are necessary to block or focus light onto the light-emitting elements when in the detection or OFF mode. Therefore, relatively simple, low-cost and small hardware assemblies may be achieved for lighting systems that include the ability to emit and detect photonic radiation using the same light-emitting elements.

The brightness of light-emitting elements for example, light-emitting diodes (LEDs) and high brightness LEDs (HBLEDs) is generally controlled using Pulse Width Modulation (PWM), Pulse Code Modulation (PCM), or other similar technique in which digital control signals are sent to switches that control activation and deactivation of the light-emitting elements. The control signal is switched ON and OFF at a rate that gives the visual effect of varying levels of brightness being emitted from the light-emitting elements rather than visual flicker. The present invention utilizes the light-emitting elements as photodetectors when they are deactivated, that is, in the OFF states of the control cycles. Therefore, the invention relies on the relatively rapid turn-on and turn-off times of light-emitting elements. When the light-emitting elements are in the OFF portion of the control cycle, they typically perform no specific function in present state-of-the-art lighting systems, therefore it is an advantage of the present invention to make use of the light-emitting elements during this OFF time.

The light-emitting elements may be used to detect ambient light, light generated by other activated light-emitting elements, light from other sources, or a combination thereof. In one embodiment of the present invention, a plurality of light-emitting elements that emit light in various regions of the electromagnetic spectrum are arranged in a system and driven digitally in a repeated ON/OFF cycle. The control cycles can be timed such that when some of the light-emitting elements are ON, others are OFF. The light-emitting elements that are OFF can produce measurable signals in response to the light produced by the light-emitting elements that are ON.

In one embodiment high brightness LEDs (HBLEDs) are used to provide a broad range of spectral responsivities. These devices can allow LEDs of one colour to be used to detect light of other colours. Furthermore, in one embodiment, the present invention employs multiple light-emitting elements of varying colours to substantially cover the visible spectrum, which is approximately 400 nm to 700 nm. Due to the nature of LEDs and their energy bandgap structure, different types of LEDs will typically have different responsivities. Generally LEDs will typically only be able to detect wavelengths of light which are of equal or shorter wavelength, for example equal or higher energy, than the radiation they emit. For example LEDs which emit light in the red region of the spectrum have a relatively low bandgap energy, and therefore when this form of LED is used as a detector it will be sensitive to wavelengths from red (~700 nm) and shorter, which includes the amber, green and blue regions of the visible spectrum. Alternately, LEDs which emit in the green region will not be sensitive to longer wavelengths of light, such as amber, red, or infrared. Similarly LEDs which emit in the blue region will only be sensitive to blue or UV light, but not infrared, red, amber, or green. This varying responsitivity of different LEDs can be used to evaluate the light output by one or more LEDs over the visible spectrum for example.

Detection Mode

When the light-emitting elements are in the OFF mode and are detecting light, the signal generated by the photons incident on the light-emitting elements can be measured. The measured signal is proportional to both the intensity and spectral content of the light and the measured signal may be a voltage or a current however, measuring a voltage can be more practical. For example, in one embodiment the measured voltage may be in the range of tens to hundreds of millivolts, wherein measurement of this characteristic can be easier than the measurement of the relative current generated as it may be in the order of microamps. In order to directly measure a current of this level, high precision devices and good filtering techniques are typically required. However, as is understood by those skilled in the art, by operating in either photovoltaic mode or photoconductive mode and converting the photocurrent to a voltage through operational amplifier circuitry (op-amp) or similar device, low light levels can be accurately measured with a desired linearity, and bandwidth.

In one embodiment, measurement of the signal generated by photons incident on the light-emitting elements in the detection mode, can include using a signal processing means for example, an analog-to-digital (A/D) converter. With appropriate processing the measured signal can be used as input signals for a feedback circuit to maintain a desired light output and colour balance produced by the lighting system. The measured signal may also be used to provide information about the light being detected. For example, information may be obtained regarding the decay of light emissions from light-emitting elements, or the change in ambient lighting conditions of a particular area. In one embodiment, a microprocessor may be used to perform A/D conversion of the detected signal in addition to the required processing and feedback adjustments subsequently used to modify the control parameters for the light-emitting elements. For some lighting systems, light measurements and feedback may not be required at a frequency greater than once per second. This typically desired frequency may not impose significant restrictions on the switching frequency used to operate the light-emitting elements, and may not result in an excessive burden on the signal processing means, for example a microprocessor.

In one embodiment, the signal processing means can include signal-conditioning circuitry to enhance the detected signal. For example, in one embodiment this signal conditioning can be done prior to A/D conversion and the signal-conditioning circuitry may include amplifiers to boost the signal or to scale the signal to a range more appropriate for the A/D converters. Alternately, or in addition, filtering circuitry, for example, band pass, high pass or low pass filters, may be added to improve the signal-to-noise ratio of the detected signal. The filtering circuitry can allow for the removal of spurious noise spikes, for example, which could cause problems within the feedback circuit.

The OFF time of light-emitting elements in typical lighting systems is generally short, and is typically 10 milliseconds or less, therefore in embodiments of the present invention, sample-and-hold circuitry may be used between the light-emitting elements and the signal processing means to capture the detected signal indicative of the incident photons on the light-emitting elements in the OFF mode.

In one embodiment of the present invention, the light-emitting elements are characterized in terms of their spectral responsivity as well as their light sensitivity in order to allow appropriately developed processing algorithms within the signal processing means to correctly interpret the light measurements represented by the signal(s) collected from the one or more light-emitting elements. In one embodiment the calibration parameters are measured once for the system and then stored in memory associated with the signal processing means for use thereby as required. This procedure can enable proper feedback, if necessary, to maintain the desired colour and intensity balance of the light created by the lighting system.

EMBODIMENTS

In one embodiment of the present invention as illustrated in FIG. 1, a single light-emitting element 14 receives switched (ON/OFF) power from power source 16. When in the ON state, the light-emitting element is activated and emits light 12. When in the OFF state, the light-emitting element 14 serves as a photodetector and measures the incident radiant flux 11 due to ambient light, for example. An optional filter 13, for example, a band pass filter that is substantially transparent to the spectral distribution of the emitted light may be employed to modify the spectral responsivity of the light-emitting element when operated as a photodetector. The detected signal is then provided to a signal processing means 15 for example, an amplifier circuit and/or an A/D converter. In another embodiment a plurality of light-emitting elements may be used to detect ambient light.

Figure 2:
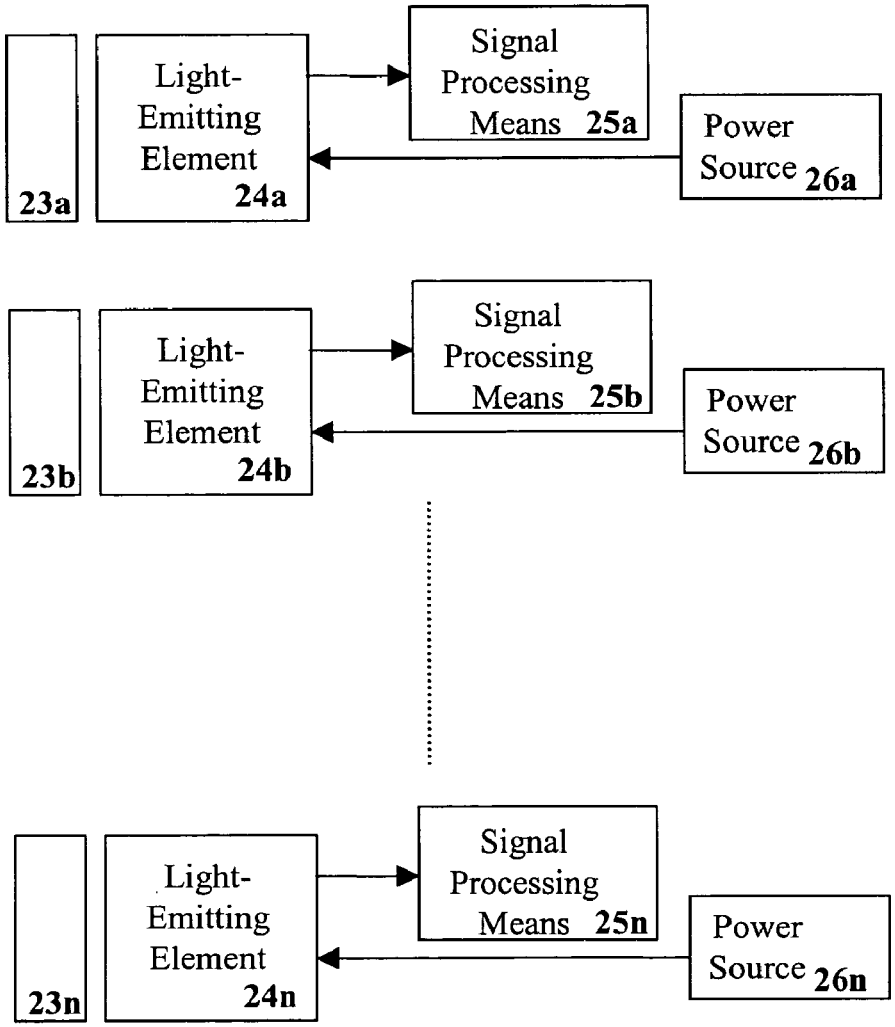
FIG. 2 illustrates one embodiment of the present invention comprising a plurality of light-emitting elements that emit and detect light.

In another embodiment of the present invention as illustrated in FIG. 2, a plurality of light-emitting elements 24*a* to 24*n* are operated alternately as light emitters and photodetectors, wherein the light-emitting elements receive switched power from power sources 26*a* to 26*n* and the phase of their drive signals may be offset such that a subset of the light-emitting elements are operated as photodetectors while the remaining light-emitting elements are emitting light. The subset of light-emitting elements that are operating as photodetectors measure the incident radiant flux due to the emission of light from the remaining light-emitting elements and may additionally measure ambient light. In another embodiment a single signal processing means receives the detected signals from two or more light-emitting elements. Similarly, in one embodiment power may be supplied to two or more light-emitting elements by a single power source. Optical filters 23*a* to 23*n* may also be used to modify the spectral responsivity of the light-emitting elements and may be band pass filters, for example.

Figure 3:
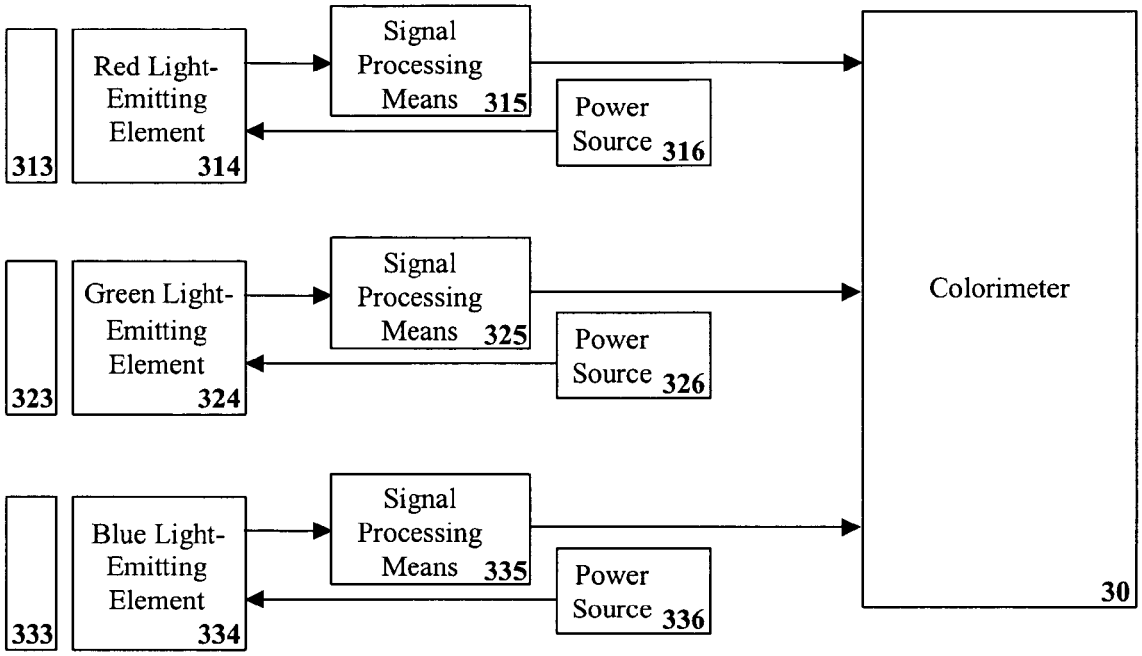
FIG. 3 illustrates one embodiment of the present invention in which a plurality of light-emitting elements emit and detect light, each associated with a different colour filter matching the light output thereby, wherein the detected signals are transmitted to a colorimeter.

In another embodiment of the present invention as illustrated in FIG. 3, light-emitting elements 314, 324, and 334 receive switched power from power source 316, 326, and 336, respectively, and emit light in the red, green and blue regions of the electromagnetic spectrum, respectively. Filters 313, 323, and 333 are substantially transparent within the spectral bandwidth of their associated light-emitting elements, that is, red, green and blue, respectively, and determine the spectral responsivity of the light-emitting elements when operated as photodetectors. The detected signals may be processed using signal processing means 315, 325 and 335 and supplied to a multi-channel colorimeter 30 to determine the luminous intensity and approximate chromaticity of the incident radiant flux. In another embodiment any desired number, arrangement and colour of light-emitting elements and respective filters may be used. The signal processing means may be an integrated single unit and similarly, the power may be supplied by an integrated single unit.

Figure 4:
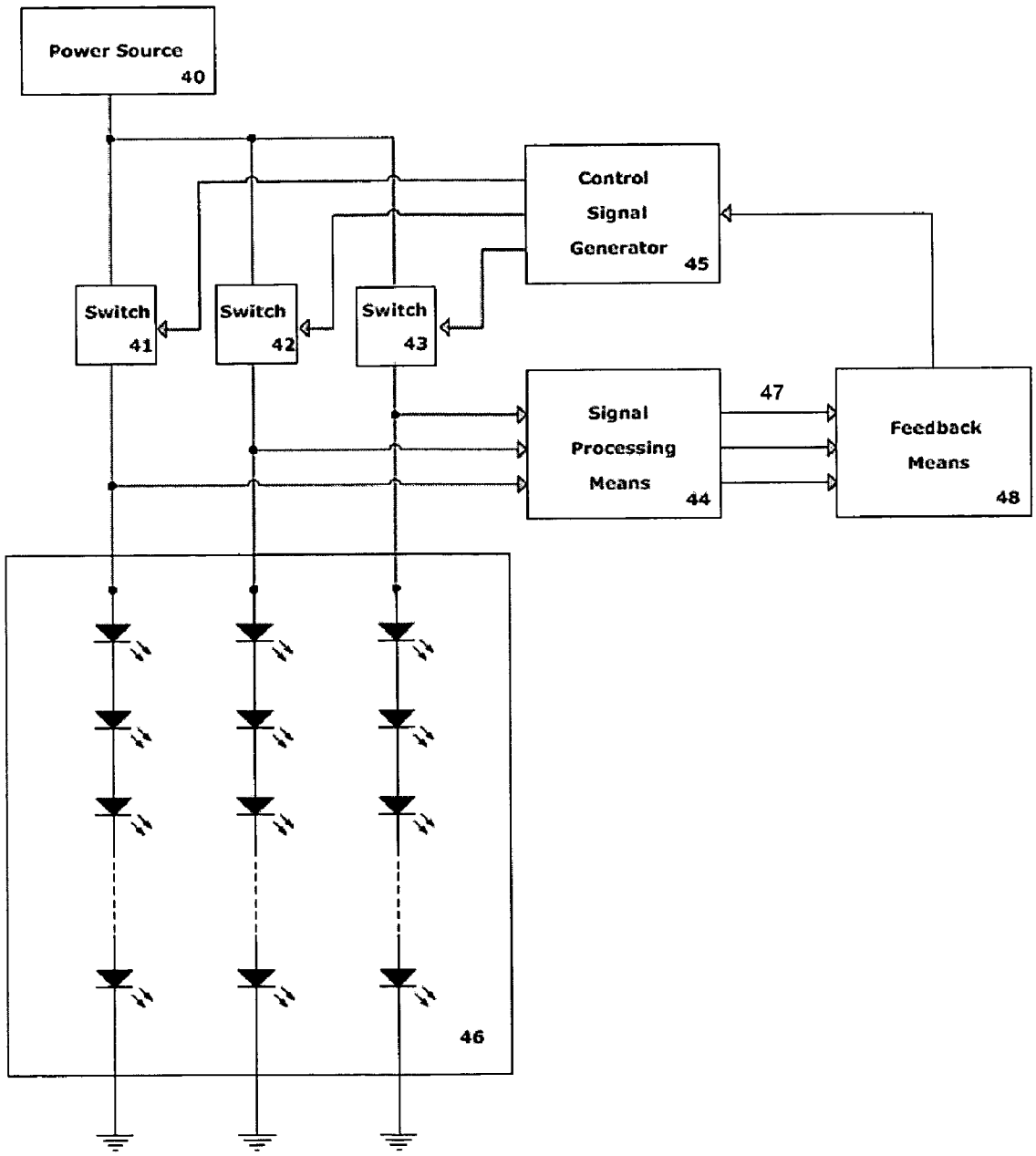
FIG. 4 illustrates a lighting system according to one embodiment of the present invention in which a plurality of light-emitting elements are switched between emission and detection and in which the detected signals are used in a feedback loop for controlling the light-emitting elements.

Another embodiment of the present invention as illustrated in FIG. 4, comprises an array of light-emitting elements 46 of various colours, a power source 40 to provide power to the light-emitting elements, and a switching means to independently connect and disconnect the light-emitting elements from the power source. The switching means comprises switches 41, 42, and 43 controlled by signals from control signal generator 45. The light-emitting elements may include red, green and blue elements such that they can combine to form white light. Amber or other colour of light-emitting elements may be additionally used to enhance the spectral power distribution of the combined white light, for example. Light-emitting elements of any number and combination however, may be selected to produce any desired colour of light. The number of strings of light-emitting elements and the number of light-emitting elements per string may also vary according to the desired application. Furthermore, a switch can be used to control power supplied to one or more light-emitting elements or one or more strings of light-emitting elements. A worker skilled in the art would readily appreciate that a plurality of configurations of switches and light-emitting elements are possible and can be integrated into a lighting system according to the present invention.

For example and with further regard to FIG. 4, for one setting of switches 41, 42 and 43 current flows through the light-emitting elements causing them to produce light. When any of the switches disconnect a light-emitting element string from power source 40, those light-emitting elements are subsequently connected to a signal processing means 44, which interprets and further processes the detected signal if required. Alternating the activation and deactivation of the light-emitting elements can allow the control signal generator 45 to maintain a certain number of the light-emitting elements activated at all times, while simultaneously performing measurements of the light emitted by the light-emitting elements using the deactivated light-emitting elements. In another embodiment the signal processing means may include signal-conditioning circuitry (not shown) to enhance the measurements. For example, this additional circuitry may comprise amplifiers to boost the signal level, or scale it to a range better optimized for signal processing. Alternately, or in addition, filtering circuitry can be added to improve the signal to noise ratio of the detected signal. The signals 47 output from the signal processing means 44 may then be optionally provided to a feedback means 48 which can then be used to adjust the control signals provided by control signal generator 45 to switches 41, 42 and 43 thereby adjusting the control parameters of the light-emitting elements being activated.

As discussed earlier, light-emitting elements such as LEDs typically only detect light of wavelengths equal or shorter than the wavelength that they emit. This enables spectral discrimination of the detected light without using filters, however this spectral discrimination can require additional processing and possibly extra circuitry, when compared to using one or more dedicated photodetectors. Thus, in one embodiment of the present invention, using light-emitting elements which emit in for example the red, green and blue regions of the visible spectrum which can be mixed together to produce white or some other colour of light, the signals from the different light-emitting elements would need to be processed in a manner that enables the extraction of the correct information about the intensity of light produced in different wavelengths. For example, with all the light-emitting elements in detection mode, the signal output thereby would indicate the ambient light levels with the blue light-emitting elements detecting ambient light in the blue region, the green light-emitting elements detecting the green and blue ambient light, and the red light-emitting elements detecting the light in the red, green, and blue regions. The data from these signals can be temporarily stored in the signal processing means, for example, and used to determine the light levels when some or all of the light-emitting elements are in emission mode. For example with the blue light-emitting elements emitting and the green light-emitting elements in detection mode, by subtracting the previously measured blue ambient signal from the signal detected by the green light-emitting elements, the intensity of the light emitted by just the blue elements can be determined, whether the red light-emitting elements are also in emission mode or not. Similarly with the blue and green light-emitting elements in emission mode and the red light-emitting elements detecting, the intensity of light produced just by the green light-emitting elements could be determined by subtracting the previously measured blue plus green ambient and also subtracting the blue emission signal. Finally, in order to measure the red emission signal, this embodiment can be configured to turn at least one of the red light-emitting elements off, namely set it to detection mode, while leaving the others in emission mode, and then subtracting the green and blue emission signals and the ambient light signals.

In a similar embodiment, with multiple light-emitting elements of different colours, by sequentially turning ON and OFF individual light-emitting elements while leaving all the rest on, and then grouping all the signals according to the colour of light-emitting element which detected it, an accurate, combined representation of both the ambient light and the total light output, including both the intensity and spectral information can be determined. This embodiment would require multiple switches, for example one for each light-emitting element, as opposed to one per string, in order to poll each light-emitting element for its detected signal.

In another embodiment, the light-emitting elements could be used only for detection of ambient light, which would eliminate the need for the polling and/or signal processing methods mentioned above. In yet another embodiment a system which had one or more light-emitting elements in each of the red, green and blue regions of the spectrum such that they are combined to produce white or another colour of light, said system able to detect and respond to changes in ambient light, only one of the three colours of light-emitting elements would need to be employed as detectors. One such embodiment would simply use the red light emitting element or elements as a detector since it would respond to all the wavelengths of visible light including red light. Another advantage of this configuration over having a separate silicon detector as an ambient light sensor is that most silicon detectors are also sensitive to infrared radiation which can result in false readings and thus may require the use of an IR blocking filter in addition to the detector, whereas using the red light emitting element as the detector does not have this problem since it is inherently insensitive to infrared radiation. Similarly other embodiments could be created which preferentially responded to only portions of the spectral content of the ambient light by taking advantage of the inherent spectral responsivities of the different colours of light-emitting elements.

Figure 5:
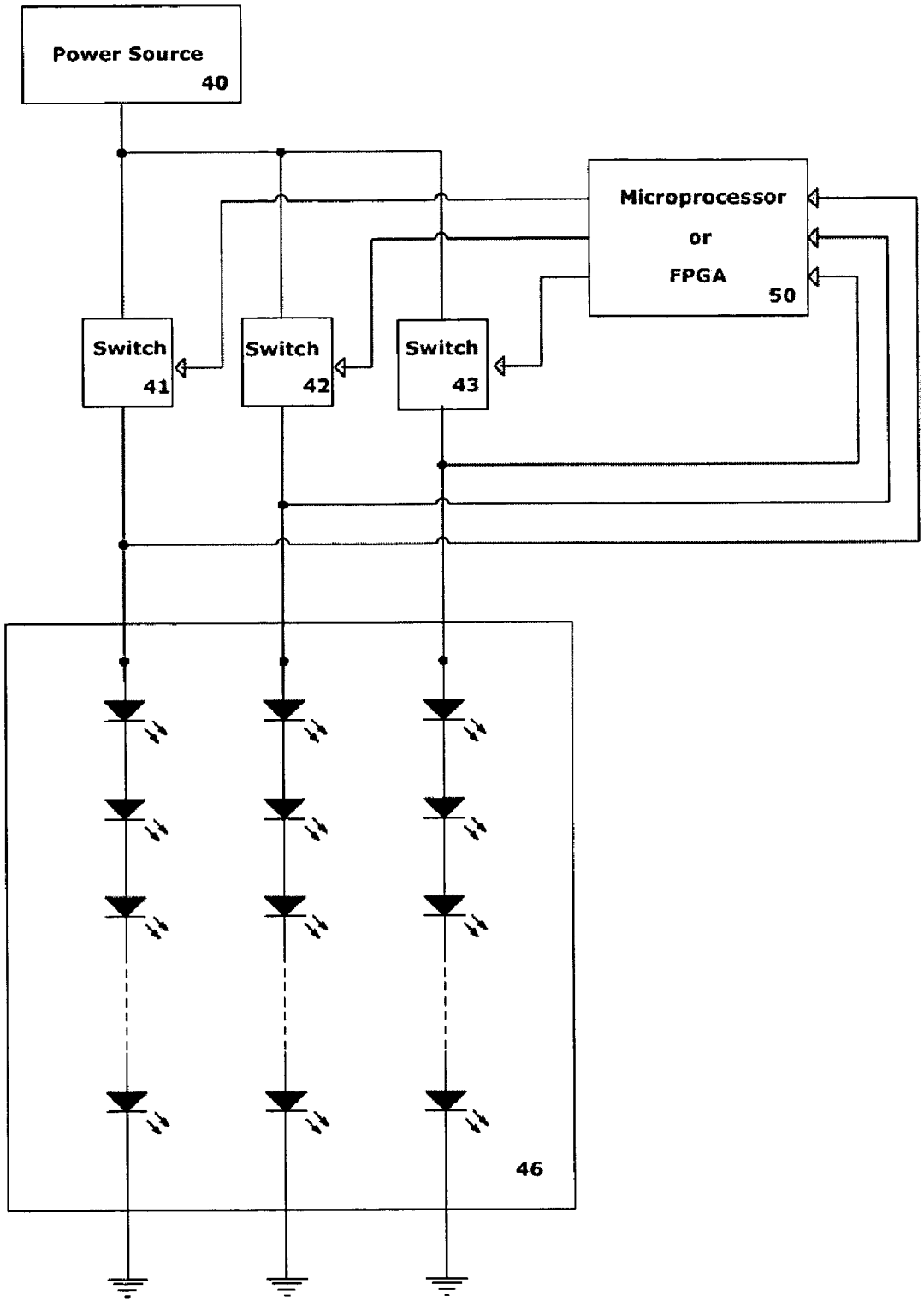
FIG. 5 illustrates a lighting system according to one embodiment of the present invention with an integrated microprocessor.

In one embodiment of the present invention, the signal processing means 44 and control signal generator 45 of FIG. 4 are integrated into a microprocessor 50 as illustrated in FIG. 5. Feedback of the detected signal to the control signal generator supplied to the light-emitting elements may also be performed by microprocessor 50. In another embodiment, signal processing of the detected signal, control signal generation and optional feedback may be implemented in an FPGA (Field Programmable Gate Array) with a microcontroller core, for example an Altera Cyclone FPGA.

Figure 6A:
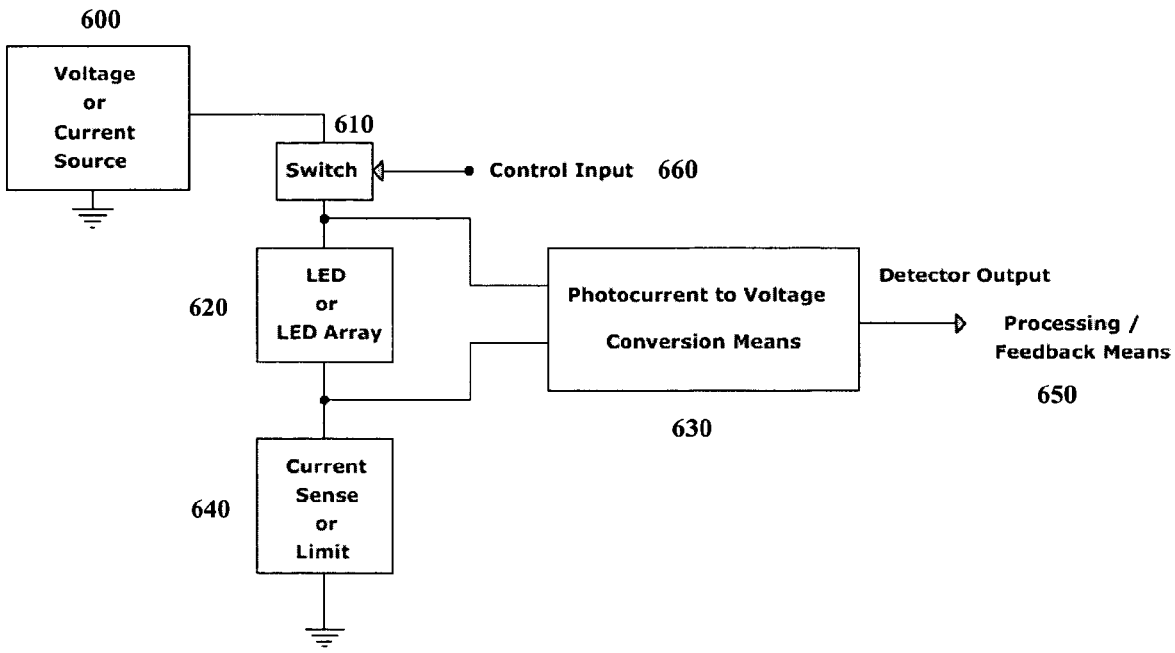
FIG. 6A illustrates an embodiment of the present invention which allows a light-emitting element to be operated as an emitter and a detector.
Figure 6B:
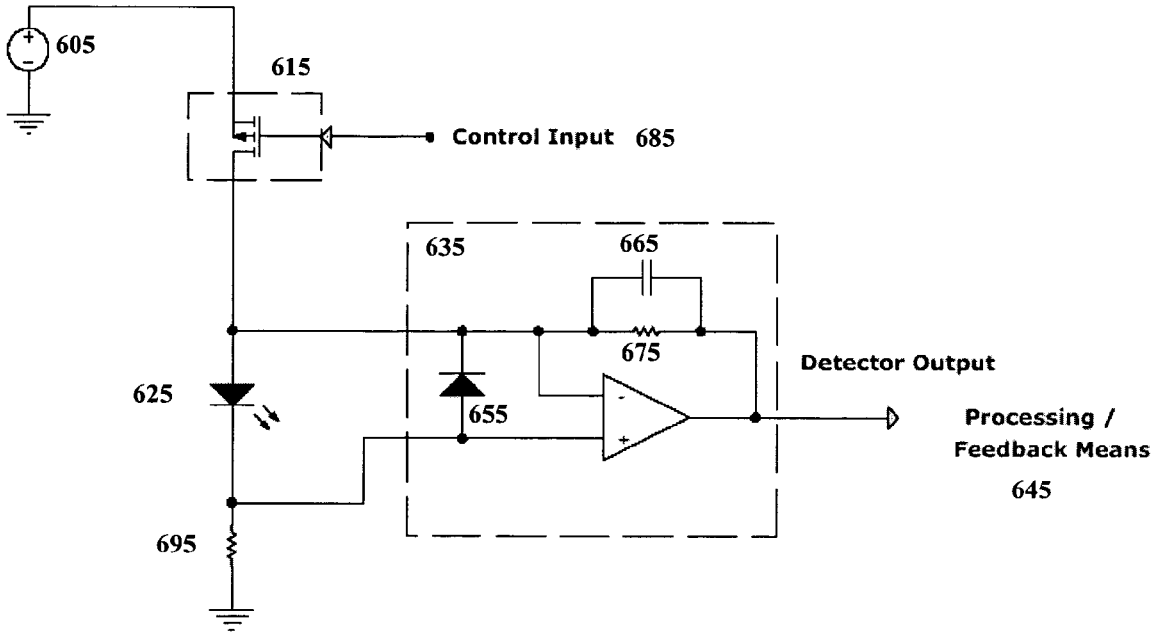
FIG. 6B illustrates a circuit diagram which can be used to implement the embodiment illustrated in FIG. 6A.
Figure 6C:
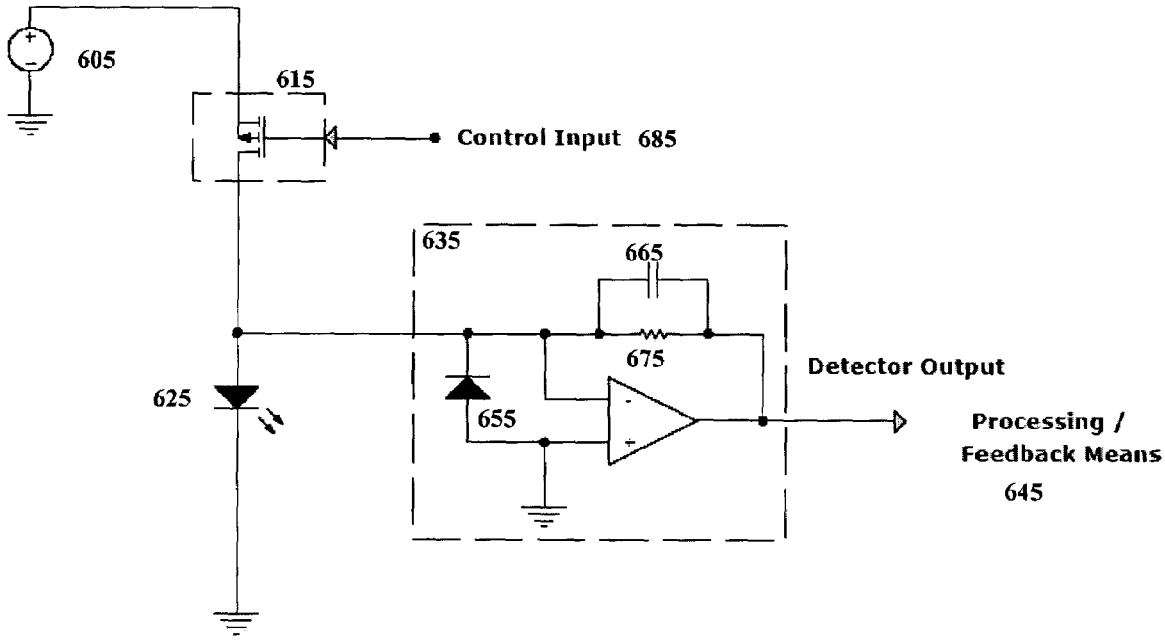
FIG. 6C illustrates an alternate circuit diagram which can be used to implement the embodiment illustrated in FIG. 6A.

FIG. 6A depicts an embodiment of a general system with a light emitting element or array 620 which can be used to both emit and detect light, consisting of a power source 600 for the light emitting element such as a constant voltage or constant current source, regulated through a switch 610 such as a transistor or relay, and connected to the signal processing means 650 and terminated by an optional device to sense or limit the current 640 if required such as a resistor, FET, or inductor. The system further comprises a conversion means 630 which provides for the conversion of photocurrent to voltage. FIG. 6B shows one embodiment which uses a FET 615 responsive to a control input 660 which could be a PWM signal, PCM signal or similar signal produced by any other digital switching method, to alternately connect and disconnect the light-emitting element 625 from the power source 605 and an op-amp detector circuit 635 to convert the photocurrent generated by the light-emitting element when in detection mode into a voltage. The sense resistor 695 may be omitted such that the cathode of the light-emitting element would be connected directly to ground without affecting the op-amp detector circuitry. FIG. 6C illustrates this embodiment wherein the non-inverting input to the op-amp is tied directly to ground. The diode 655 in the op-amp detector circuit is to damp ringing which can occur when the light- emitting element is switched over to detection mode. The capacitor 665 performs a similar function and would need to be sized according to the application but in one embodiment is in the range of 20 pF. Finally the feedback or gain resistor 675 is used to adjust the sensitivity of the op-amp detector circuit depending on the intensity of light to be detected so that it neither saturates when exposed to high intensities, nor yields too small a signal to be distinguished from a noise threshold when exposed to low intensities. In one embodiment the resistor is in the range of a few mega-ohms. The output from the op-amp detector circuit 635 is subsequently transmitted to the processing means 645 thereby enabling evaluation of a desired control input 685.

Figure 7:
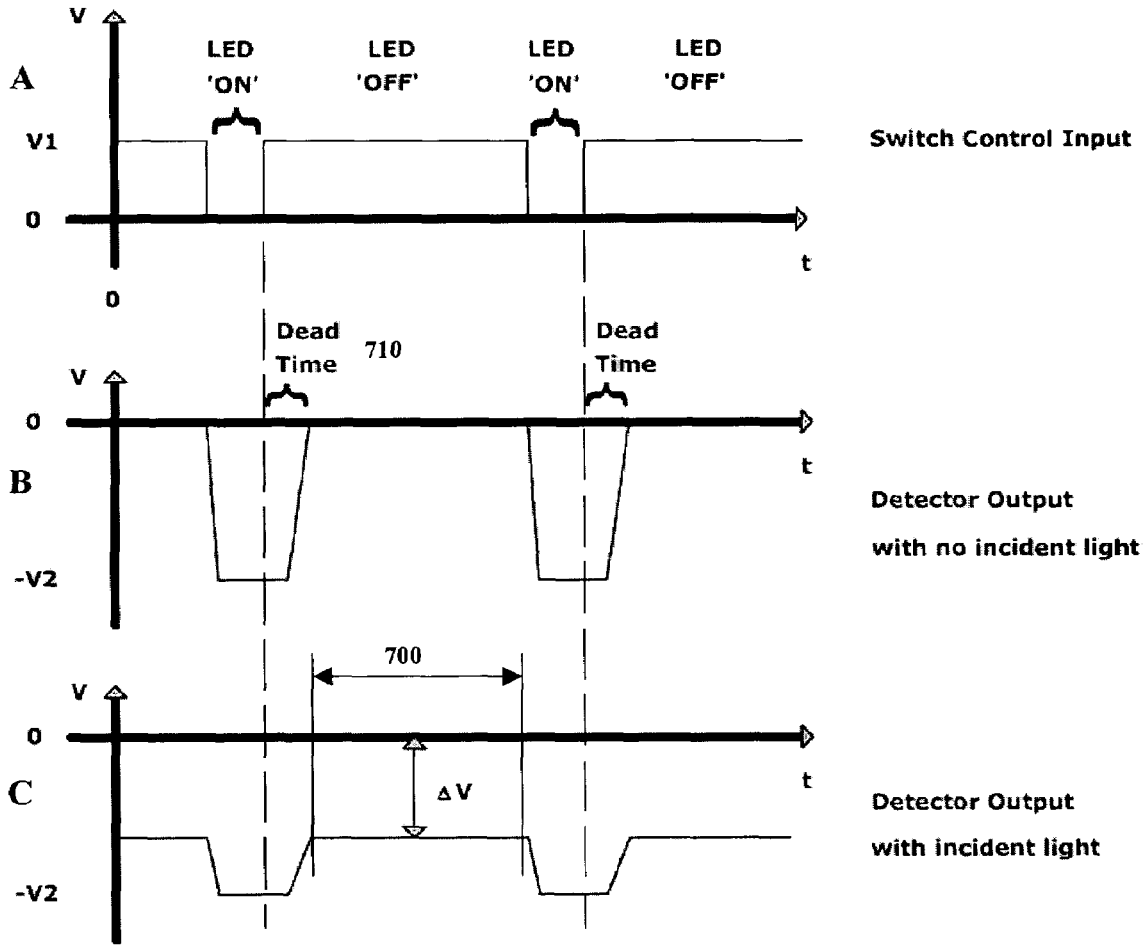
FIG. 7 illustrates a set of waveforms corresponding to the operation of the embodiment shown in FIGS. 6A and 6B.

FIG. 7 depicts a series of waveforms which relate to the operation of the embodiment illustrated in FIG. 6B. Waveform A shows a regular repeating digital voltage signal, for example a PWM signal, applied to the gate of the FET switch used to turn the light-emitting element 'ON' and 'OFF', which corresponds respectively to connecting it to the power source so that it emits light, and disconnecting it from the power source so that it can detect light. Waveform B shows the output of the op-amp detector circuitry corresponding to the 'ON' and 'OFF' signals above during which time there is no light incident on the light-emitting element. As can be seen, when the light-emitting element is 'ON', it cannot be used to detect light since the op-amp detector circuitry almost immediately reaches the saturation level (−V2) after the light-emitting element is switched 'ON'. Also it can be seen that for some short time after the light-emitting element is switched 'OFF', the op-amp detector circuitry remains saturated and this is labeled as 'Dead Time' 710. Therefore in this embodiment, the useful detection period 700 would be the difference between the 'OFF' time and the 'Dead Time'. Waveform C shows how the op-amp detector circuit output responds when light is incident on the light-emitting element. During the useful detection period 700, the output signal is some level (ΔV) below the nominal or zero light level. The magnitude of this ΔV is proportional to the intensity of the light incident on the light-emitting element and the gain resistor 675 in the op-amp detector circuitry. Therefore in one embodiment in which the approximate expected level of the incident light is known, the gain resistor 675 can be set to ensure that output of the op-amp detector circuitry will always fall between 0 and −V2. In another embodiment, the gain of the op-amp detector circuitry can be dynamically adjusted using a potentiometer to ensure a desired signal level ΔV can be obtained. In addition, as would be understood by one skilled in the art, the output of the op-amp detector circuit can be inverted and/or amplified to provide a signal that can be more readily accepted by a standard microprocessor or A/D converter.

In one embodiment, the 'Dead Time' 710 imposes a limit on the maximum PWM frequency and duty cycle that can be used before the useful detection period 700 would be lost. In this embodiment frequencies only up to a few kilohertz, for example less than or equal to 5 kHz and duty cycles up to 99%, which is dependent on the frequency, can be utilized while still allowing the light-emitting element to be used as a detector, wherein the resulting minimum time to be able to detect incident light can be of the order of one millisecond.

In another embodiment wherein the lighting system is running a PWM signal at frequencies higher than or equal to 5 kHz, the switch control input can be over-ridden to shut the one or more of the light-emitting element off for several periods until a useful detection period can be obtained. The output of the op-amp detector circuitry can be recorded and processed and subsequently the normal PWM signal can be restored. This process can be configured in a microprocessor based system as would be readily understood by one skilled in the art.

The embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A lighting system comprising:

a) one or more light-emitting elements for emission and detection of light;

b) a control means for switching the one or more light emitting elements between a first emission mode and a second detection mode, the control means adapted for connection to a power source; and c) a signal processing means operatively connected to the one or more light-emitting elements, the signal processing means for receiving one or more first signals generated by the one or more light-emitting elements in response to light incident thereupon when in the second detection mode.

2. The lighting system according to claim 1, further comprising a conversion device operatively connected to the one or more light-emitting elements and the signal processing means, the conversion device configured to convert the one or more first signals from a photocurrent to a voltage.

3. The lighting system according to claim 2, wherein the signal processing means is operatively connected to a feedback means, the feedback means providing the control means with one or more parameters for controlling operation of the one or more light-emitting elements based on one or more second signals received from the signal processing means, the one or more second signals representative of the one or more first signals.

4. The lighting system according to claim 3, wherein one or more of the signal processing means, the feedback means and the control means are integrated into a microprocessor or a field programmable gate array.

5. The lighting system according to claim 2, wherein the signal processing means is an analog-to-digital converter.

6. The lighting system according to claim 2, wherein the signal processing means comprises signal-conditioning circuitry for enhancing the one or more first signals generated by the one or more light-emitting elements.

7. The lighting system according to claim 6, wherein the signal-conditioning circuitry comprises an amplifier to boost or scale the one or more first signals.

8. The lighting system according to claim 2, wherein the signal processing means comprises filtering circuitry for modifying a signal to noise ratio associated with the one or more first signals generated by the one or more light-emitting elements.

9. The lighting system according to claim 8, wherein the filtering circuitry comprises one or more filters selected from the group comprising band pass, high pass and low pass.

10. The lighting system according to claim 2, further comprising sample-and-hold circuitry operatively connected to the one or more light-emitting elements and the signal processing means, said sample-and-hold circuitry for capturing the one or more first signals generated by the one or more light-emitting elements.

11. The lighting system according to claim 2, further comprising a filter operatively coupled to the one or more light-emitting elements, the filter configured to be substantially transparent to the light emitted by the one or more light-emitting elements when in the first emission mode and configured to modify spectral responsivity of the one or more light-emitting elements when operating in the second detection mode.

12. The lighting system according to claim 2, wherein the conversion device is an operational amplifier circuit.

13. The lighting system according to claim 12, wherein the operational amplifier circuit comprises a gain resistor configured based on predefined minimum and maximum light intensity levels, the operational amplifier circuit thereby generating output within a desired range.

14. The lighting system according to claim 12, wherein the operational amplifier circuit comprises a potentiometer thereby providing a means for dynamically adjusting gain of the operational amplifier circuit.

15. The lighting system according to claim 12, wherein the operational amplifier circuit comprises a diode for damping ringing upon switching of the one or more light emitting elements from the first emission mode to the second detection mode.

16. The lighting system according to claim 2, further comprising a sense resistor operatively connected to the one or more light-emitting elements.

17. The lighting system according to claim 2, wherein the signal processing means is operatively connected to a colorimeter for determining luminous intensity and chromaticity of the light incident upon the one or more light-emitting elements.

18. The lighting system according to claim 2, wherein the one or more light-emitting elements comprises a plurality of light-emitting elements configured to emit light of one or more colours.

19. The lighting system according to claim 18, wherein the one or more colours includes red, green and blue.

20. The lighting system according to claim 19, wherein the one or more colours further includes amber.

21. The lighting system according to claim 4, wherein the microprocessor is configured to account for spectral responsivity of each of the one or more light-emitting elements, wherein the spectral responsivity is dependent on emission colour of each one or more light-emitting elements emission colour.

22. The lighting system according to claim 21, wherein each of the one or more light-emitting elements are polled for respective signals representative of the light incident thereon.

23. The lighting system according to claim 2, wherein the control means switches the one or more light-emitting elements using a digital switching signal.

24. The lighting system according to claim 23, wherein the digital switching signal is a pulse width modulation signal or a pulse code modulation signal.

25. The lighting system according to claim 24, wherein the pulse width modulation signal has a switching frequency of less than or equal to 5 kHz.

26. The lighting system according to claim 24, wherein the pulse width modulation signal has a switching frequency of greater than or equal to 5 kHz, wherein the control means comprises a mechanism to over-ride the pulse width modulation signal and thereby place one or more of said light-emitting elements into the second detection mode for multiple cycles, thereby providing sufficient time to detect the signal generated by the one or more light-emitting elements in response to light incident thereupon.

* * * * *